US007685666B2

(12) United States Patent
Keidel et al.

(10) Patent No.: US 7,685,666 B2
(45) Date of Patent: Mar. 30, 2010

(54) METHOD FOR PRODUCING WATERPROOF SEAMS

(75) Inventors: Karsten F. Keidel, Kirchheimbolanden (DE); Liviu M. Pavalescu, Neuss (DE); Paul E. Raith, Haan (DE)

(73) Assignee: Sympatex Technologies GmbH, Unterfohring (DE)

( * ) Notice: Subject to any disclaimer, the term of this patent is extended or adjusted under 35 U.S.C. 154(b) by 755 days.

(21) Appl. No.: 11/485,386

(22) Filed: Jul. 13, 2006

(65) Prior Publication Data

US 2007/0011832 A1 Jan. 18, 2007

(30) Foreign Application Priority Data

Jul. 13, 2005 (EP) ..... 05015169

(51) Int. Cl.
*A43B 13/28* (2006.01)

(52) U.S. Cl. ..... 12/142 C; 36/21; 36/23

(58) Field of Classification Search ..... 12/142 C, 12/142 F, 142 T, 142 R, 142 B; 36/21, 23
See application file for complete search history.

(56) References Cited

U.S. PATENT DOCUMENTS 4,261,072 A * 4/1981 Senter ..... 12/142 D
5,285,546 A * 2/1994 Haimerl ..... 12/142 E
5,505,011 A * 4/1996 Bleimhofer ..... 36/4
5,628,127 A * 5/1997 Notzold ..... 36/14
5,732,429 A * 3/1998 Strickland ..... 12/142 D
5,732,480 A * 3/1998 Notzold ..... 36/14
6,088,935 A * 7/2000 Pavelescu et al. ..... 36/14
6,604,302 B2 * 8/2003 Polegato ..... 36/55
6,823,551 B2 * 11/2004 Keidel et al. ..... 12/142 F
7,010,868 B2 * 3/2006 Haimerl et al. ..... 36/12
7,017,284 B2 * 3/2006 Keidel et al. ..... 36/14

FOREIGN PATENT DOCUMENTS

EP 0 916 275 A2 5/1999

* cited by examiner

*Primary Examiner*—Ted Kavanaugh
(74) *Attorney, Agent, or Firm*—Oliff & Berridge, PLC

(57) ABSTRACT

Method for sealing seams in shoes having an exterior upper with a lower end, an interior upper with a lower end, an insole with a circumferential edge, and a sole, the lower end of the exterior upper, the lower end of the interior upper, and the outer edge of the insole being sewn together, characterized in that a tape is selected that is provided on both sides with a layer that is adhesive at room temperature, and that this tape is used to join and fix the lower end of the exterior upper to the lower end of the interior upper before the exterior upper, interior upper, and insole are sewn together.

3 Claims, 1 Drawing Sheet

METHOD FOR PRODUCING WATERPROOF SEAMS

This application claims priority from European Patent Application 05-015169.5, filed Jul. 13, 2005, the disclosure of the priority application is hereby incorporated by reference herein in its entirety.

BACKGROUND

This disclosure relates to a method for sealing seams in shoes having an exterior upper with a lower end, an interior upper with a lower end, an insole with a circumferential edge, and a sole, the lower end of the exterior upper, the lower end of the interior upper, and the outer edge of the insole being sewn together.

A method for sealing shoe seams is disclosed by EP 0 916 275, for example. In that invention, the interior upper has a waterproof extension via which the joint with the end of the interior upper and the outer edge of the insole is established. This type of sealing is complex.

SUMMARY

It is an object of the disclosed embodiment to further simplify the production of waterproof seams during shoe manufacture.

DETAILED DESCRIPTION OF EMBODIMENTS

Figure 1:
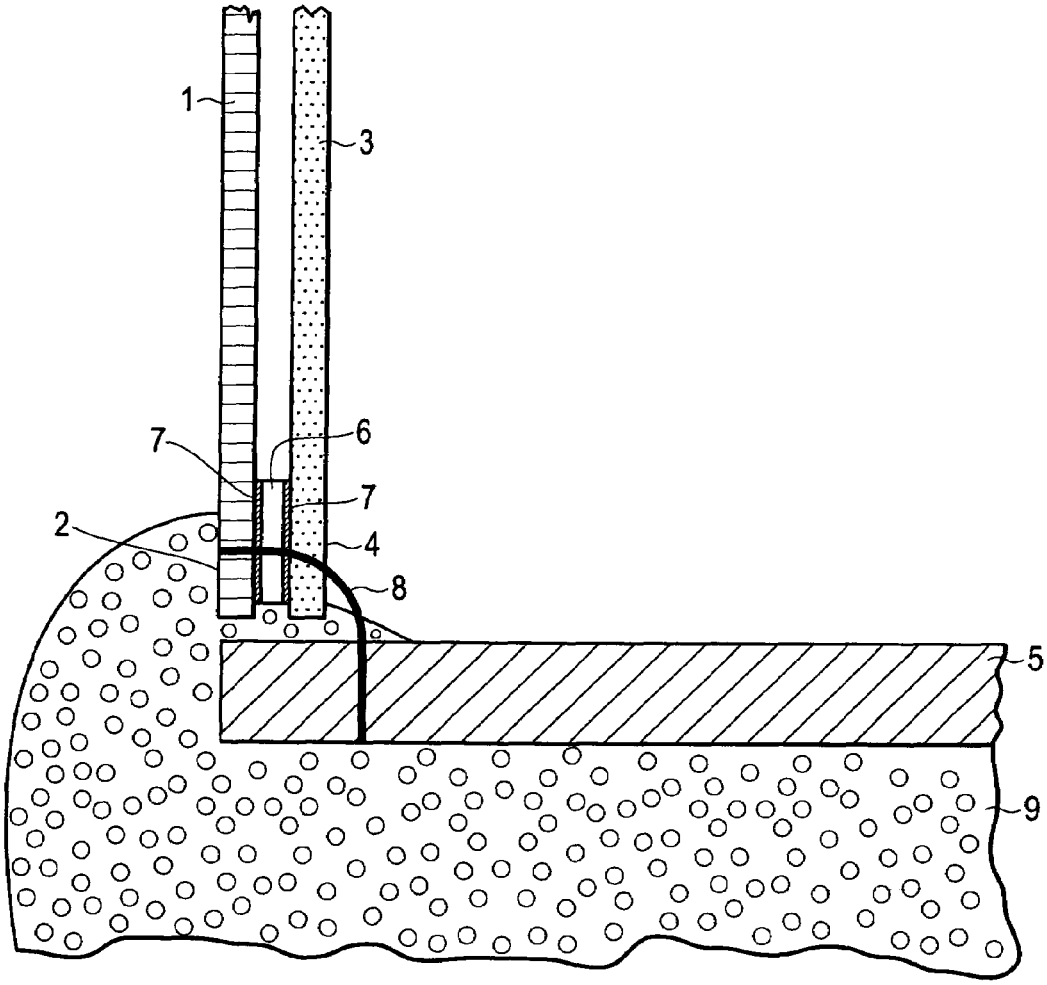
FIG. 1 is a sectional view of a portion of a side of a shoe manufactured by this method.

With reference to FIG. 1, the object is achieved by a method in which a tape 6 is selected that is provided on both sides with a layer 7 that is adhesive at room temperature, and the tape 6 is used to join and fix the lower end of the exterior upper 2 to the lower end of the interior upper 4 before the exterior upper 1, interior upper 3, and insole 5, which is attached to the sole 9, are sewn together with a seam 8.

In simple cases, particularly when the tape 6 employed consists of an elastic material, a subsequent heat treatment to melt the tape may not be required, because the tape 6 may conform to the seam material, forming a watertight seam. This may be especially true when a monofilament thread is used as the seam material.

Also, a tape 6 may be selected that consists of a material that melts on application of heat. After sewing the exterior upper 1, interior upper 3, and insole 5 together, heat may be applied to the seam, melting the tape 6 and sealing the openings (not shown) produced by the seam 8. This may be achieved, for example, by ironing the finished seams at a temperature conducive to melting the tape.

This method succeeds particularly well in the case of shoes with an injection-molded sole 9, because the heat formed after applying the sole material normally suffices to melt the tape 6 arranged between the exterior and interior uppers 1 and 3 and sewn together with them, resulting in sealing of the openings produced by the seam 8.

Heat can also be generated or applied using high-frequency radiation. In this way, it may be possible to be highly selective in melting the tape 6 at those locations required for sealing the openings produced by the seam 8.

This method may be especially suited for shoes having a waterproof, water-vapor-permeable functional layer between the exterior upper and lining, in which the functional layer generally forms a laminate with the lining. In this case, the tape may be inserted between the exterior upper and functional layer, resulting in the interior upper, which contains the functional layer, being fixed to the exterior upper prior to sewing.

Although the invention has been described with reference to specific embodiments, those embodiments should be viewed as illustrating and not limiting. Various modifications, substitutions and improvements are possible within the spirit and scope of the invention.

What is claimed is:

1. A method for sealing seams in shoes having an exterior upper with a lower end, an interior upper with a lower end, an insole with a circumferential edge, and a sole, comprising:

joining and fixing the lower end of the exterior upper to the lower end of the interior upper with a tape, the tape being provided with a layer that is adhesive at room temperature on both sides of the tape, and the tape is used to join and fix the lower end of the exterior upper to the lower end of the interior upper before the exterior upper, interior upper, and insole are sewn together; and sewing together the lower end of the exterior upper, the lower end of the interior upper, and the outer edge of the insole.

2. The method for sealing seams in shoes according to claim 1, wherein a tape is selected that consists of a material that melts on application of heat such that the tape is melted, at least in the vicinity of a seam of the shoe, resulting in sealing of the openings produced by the seam.

3. The method for sealing seams in shoes according to claim 2, wherein heat is generated using high-frequency radiation.

* * * * *